US012290126B2

(12) United States Patent
Morgan et al.

(10) Patent No.: US 12,290,126 B2
(45) Date of Patent: May 6, 2025

(54) HELMET ASSEMBLY

(71) Applicant: Tate Technology, LLC, Pacific Palisades, CA (US)

(72) Inventors: Jenny Tate Morgan, Pacific Palisades, CA (US); Gerard Earl Morgan, III, Sandy, UT (US)

(73) Assignee: TATE TECHNOLOGY, LLC, Pacific Palisades, CA (US)

( * ) Notice: Subject to any disclaimer, the term of this patent is extended or adjusted under 35 U.S.C. 154(b) by 150 days.

(21) Appl. No.: 17/126,832

(22) Filed: Dec. 18, 2020

(65) Prior Publication Data

US 2021/0227919 A1 Jul. 29, 2021

Related U.S. Application Data

(60) Provisional application No. 62/967,250, filed on Jan. 29, 2020.

(51) Int. Cl.
*A42B 3/20* (2006.01)
*A42B 3/08* (2006.01)
(Continued)

(52) U.S. Cl.
CPC ..... *A42B 3/163* (2013.01); *A42B 3/08* (2013.01); *A42B 3/166* (2013.01); *A42B 3/20* (2013.01);
(Continued)

(58) Field of Classification Search
CPC ..... A42B 3/163; A42B 3/166; A42B 3/221; A42B 3/08; A42B 3/10; A42B 3/20;
(Continued)

(56) References Cited

U.S. PATENT DOCUMENTS 2,786,102 A * 3/1957 Frieder ..... A42B 3/166 381/376
6,324,701 B1 * 12/2001 Alexander ..... A42B 3/08 2/421

(Continued)

OTHER PUBLICATIONS

International Search Report and Written Opinion issued in PCT/US21/13348.

*Primary Examiner* — Sally Haden
*Assistant Examiner* — Giao Qt Hoang
(74) *Attorney, Agent, or Firm* — Jeffer Mangels Butler & Mitchell LLP; Brennan C. Swain, Esq.

(57) ABSTRACT

A helmet assembly including a helmet shell having a face opening, first and second chin projections, an outer surface an inner surface, and a faceguard. The face opening is at least partially defined by a forehead edge. At least a first tunnel member is disposed on the inner surface adjacent the forehead edge. First and second receiving members are disposed on the inner surface on the first and second chin projections, respectively. The faceguard includes upper and lower sections. The upper section includes at least a first prong member extending upwardly therefrom that is removably received in a secured position in the first tunnel member. The lower section includes first and second wing members extending therefrom that are removably received in a secured position in the first and second receiving members, respectively.

19 Claims, 9 Drawing Sheets

(51) Int. Cl.

| | |
|---|---|
| ***A42B 3/16*** | (2006.01) |
| *A42B 3/04* | (2006.01) |
| *A42B 3/18* | (2006.01) |
| *A42B 3/22* | (2006.01) |

(52) U.S. Cl.
CPC . *A42B 3/04* (2013.01); *A42B 3/18* (2013.01); *A42B 3/205* (2013.01); *A42B 3/22* (2013.01)

(58) Field of Classification Search
CPC ..... A42B 3/205; A42B 3/04; A42B 3/0406; A42B 3/18; A42B 3/22; A42B 3/223
See application file for complete search history.

(56) References Cited

U.S. PATENT DOCUMENTS

| | | | | |
|---|---|---|---|---|
| 6,826,783 | B1 * | 12/2004 | Grove | A42B 3/288 128/201.25 |
| 7,328,462 | B1 * | 2/2008 | Straus | A42B 3/067 2/411 |
| 7,886,370 | B2 * | 2/2011 | Winningham | A63B 71/10 2/9 |
| 8,782,819 | B1 * | 7/2014 | Culpepper | A42B 3/10 2/410 |
| 9,314,060 | B2 | 4/2016 | Giles | |
| 9,788,592 | B2 * | 10/2017 | Cheng | A42B 3/222 |
| 10,702,001 | B2 | 7/2020 | Morgan et al. | |
| 2005/0235401 | A1 | 10/2005 | Foote | |
| 2005/0273911 | A1 | 12/2005 | Skiba | |
| 2008/0163410 | A1 | 7/2008 | Udelhofen | |
| 2009/0044316 | A1 | 2/2009 | Udelhofen | |
| 2009/0106882 | A1 | 4/2009 | Nimmons | |
| 2014/0331393 | A1 * | 11/2014 | DaSilva | A42B 3/08 2/414 |
| 2016/0000167 | A1 * | 1/2016 | Alley | A42B 3/22 2/412 |
| 2017/0311669 | A1 * | 11/2017 | Morin | A42B 3/205 |
| 2017/0367429 | A1 * | 12/2017 | Infusino | A42B 3/08 |
| 2019/0014852 | A1 * | 1/2019 | An | A42B 3/326 |
| 2019/0307201 | A1 * | 10/2019 | Neal | A42B 3/20 |

* cited by examiner

HELMET ASSEMBLY

CROSS REFERENCE TO RELATED APPLICATIONS

This application claims the benefit of U.S. Provisional Application No. 62/967,250, filed Jan. 29, 2020, the entirety of which is incorporated herein by reference.

FIELD OF THE INVENTION

The invention generally relates to protective headwear and gear, such as padding, body armor, etc.

BACKGROUND OF THE INVENTION

Prior art American football helmets are used in all levels of the game of American football played from the professional NFL and collegiate NCAA level on down to very young children in Pop Warner and other leagues playing football using and wearing equipment including and specifically helmetry. Prior art helmets also include faceguards, ear ports, chin straps, and radio systems, as well as various liner systems using pads, air, fluids, etc. therein.

SUMMARY OF THE PREFERRED EMBODIMENTS

In accordance with a first aspect of the present invention there is provided a helmet assembly including a helmet shell having a face opening, first and second chin projections, an outer surface an inner surface, and a faceguard. The face opening is at least partially defined by a forehead edge. At least a first tunnel member is disposed on the inner surface adjacent the forehead edge. First and second receiving members are disposed on the inner surface on the first and second chin projections, respectively. The faceguard includes upper and lower sections. The upper section includes at least a first prong member extending upwardly therefrom that is removably received in a secured position in the first tunnel member. The lower section includes first and second wing members extending therefrom that are removably received in a secured position in the first and second receiving members, respectively. In a preferred embodiment, the first prong member is curved. In a preferred embodiment, the first prong member includes a distal end and when the first prong member is in the secured position, the distal end of the first prong member is located outside of the first tunnel member.

In a preferred embodiment, the first wing member includes a distal end and when the first wing member is in the secured position, the distal end of the first prong member is located outside of the first receiving member and the second wing member includes a distal end and when the second wing member is in the secured position, the distal end of the second wing member is located outside of the second receiving member. In a preferred embodiment, the inner surface of the bottom wall of the first receiving member is curved. Preferably the curvature of the inner surface matches, mimics or approximates the curvature of the first prong member and/or the curvature of the inner surface of the outer shell. In a preferred embodiment, the first securement system includes a first latch member pivotably connected to the distal end of the first wing member and the second securement system includes a second latch member pivotably connected to the distal end of the second wing member.

In a preferred embodiment, the helmet assembly includes an inner liner positioned inside the helmet shell and the inner liner or inner liner bracket assembly comprises a plurality of band members. Preferably, the helmet assembly includes a chin strap assembly that includes a chin receiver member and first and second straps. The chin receiving member includes a trough defined therein and first and second bridge members that span the trough, wherein the straps include a proximal end attached to the inner liner. Preferably, the chin receiving member includes a trough defined therein and first and second bridge members that span the trough. The first strap extends under the first bridge member and into the trough and the second strap extends under the second bridge member and into the trough. The first and second straps include distal ends that include complementary latch members that are configured to latch to one another within the trough. In a preferred embodiment, the trough is deep enough so that the straps and latch members are seated within the trough at a level below and outer surface of the chin receiver member.

In accordance with another aspect of the present invention there is provided a helmet assembly that includes a helmet shell with an inner surface, an outer surface and first and second noise attenuating ear port assemblies. The first noise attenuating ear port assembly includes a first ear port defined through the helmet shell, and the second noise attenuating ear port assembly includes a second ear port defined through the helmet shell. In a preferred embodiment, the first noise attenuating ear port assembly includes a plurality of first spiral recesses defined in the outer surface of the helmet shell. The plurality of first spiral recesses surround the first ear port. The second noise attenuating ear port assembly includes a plurality of second spiral recesses defined in the outer surface of the helmet shell and the plurality of second spiral recesses surround the second ear port.

In a preferred embodiment, the first noise attenuating ear portion assembly includes a first circular outer edge. Each of the plurality of first spiral recesses includes a bottom surface that spirals inwardly from the first circular outer edge to the first ear port. The second noise attenuating ear portion assembly includes a second circular outer edge, and each of the plurality of second spiral recesses includes a bottom surface that spirals inwardly from the second circular outer edge to the second ear port. Preferably, the plurality of first spiral recesses are separated by and at least partially defined by a plurality of walls and the plurality of second spiral recesses are separated by and at least partially defined by a plurality of walls.

In a preferred embodiment, the first noise attenuating ear port assembly includes a first active noise cancellation assembly, and the second noise attenuating ear port assembly includes a second active noise cancellation assembly. Preferably, the first active noise cancellation assembly includes at least a first transmitter and a first receiver positioned adjacent the first ear port, and the second active noise cancellation assembly includes at least a first transmitter and a first receiver positioned adjacent the second ear port.

The present invention relates generally to a football helmet assembly that includes a particular helmet shell shape, air vents, faceguard, ear ports, and chin strap. The helmet design of the present invention includes a helmet shell shape that can incorporate the teachings of U.S. Pat. No. 9,314,060 (the "'060 patent") and U.S. Pat. No. 10,702,001 (the "'001 patent"), the entireties of which are incorporated herein by reference. The present invention also may include chips, sensors, batteries, transmitters, receivers and microphones.

A complete helmet shell and faceguard assembly system comprising a helmet shell that defines an interior and an exterior containing openings, a helmet shell assembly with openings for multiple air vents, a helmet shell assembly that includes a faceguard or mask that snaps into and connects or unites exactly even, or on an even plane with the helmet shell in the front opening or area of the helmet shell, as well as connects, unites on an even plane with the two chin areas in the helmet shell, a helmet shell assembly that includes two ear port openings located over the wearers ear areas that address crowd noise or frequency attenuation, as well as reducing the range of frequencies to specific Hertz ranges heard by the wearer, a helmet shell assembly that includes a chin strap assembly that can accommodate the '060 patent helmet and attaches or secures to the inner liner system and/or the outer helmet shell of the helmet disclosed in the '001 patent or the outer helmet shell system in the '060 patent, a complete helmet shell assembly or unit with an open area in the face area of a helmet shell where the faceguard assembly that is removable from a closed position with the helmet shell assembly when it is snapped into grooves and snaps into the helmet shell, and where the helmet shell and faceguard assembly when snapped in the helmet shell are one unit or contiguous, or more monolithic as one unit, and ear ports or openings over the wearers ear areas that are designed and configured to reduce crowd noise Hertz frequency and decibel levels, so helmet wearers may hear other players at specified decibel and frequency levels with them on the field of play in football and other sports, which are different Hertz and decibel levels and a chin strap assembly that attaches to the outer shell that this new design will accommodate the helmet of the '001 patent and its ability to rotate the helmet shell independent of the wearer without obstruction or limitation for multiple degrees of helmet shell rotational freedom, and a helmet shell assembly that includes at compression impact and health data sensor capture technology systems. An at compression data sensor capture technology system device to be used for sports activities, military use, and construction or industrial use is also described where impact force is taken at initial impact or compression at the impact's peak severity versus in tension at the wearer's head. Three impact engaging members housing the hardware, code, mother board, software, algorithms, accelerometers, gyros, g-force capture, health capture capabilities of key pertinent medical data usually taken at an emergency room or a doctor's office of the sensor(s) are designed with use of the aforementioned patents with proven ability to read, capture and transmit health data, plus be able to read, capture, and transmit impact force taken at the point of impact or at compression versus in tension coupled with sensor(s) designed to read bio-metric vitals. U.S. patent application Ser. No. 16/945,585, filed Jul. 31, 2020, which discloses a helmet that includes an impact and health data sensing system is also incorporated by reference herein in its entirety.

In a preferred embodiment, and in accordance with the first aspect of the present invention there is provided a new helmet shell design assembly that can be used with the helmets described in the '060 patent and '001 patent or with other helmets, and that includes and defines in the helmet shell and design that the shell has a generous or oversize shell and current helmet shell sizes with a smooth exterior surface, meaning no undulations, indents, outcroppings, with the exception of holes designed for multiple air vents, and that has an opening for the face, has openings for air vents, and openings for the wearer's ear areas, with an extension of the lower helmet shell having an extended area to cover the jaw area, or mandible or maxilla, has noise cancelling or frequency wave attenuating ear ports, a chin strap securement and design, and a faceguard design and attachment system to the shell design of the present invention. The helmet design of the present invention uses receiving paths or grooves to guide attachment appendages, members, arms or prongs, shelves, ledges, pathways, spring loaded release systems, ratchet mechanisms, tongue and groove methods to merge, join, meet in an overlapping structure for strength to two surfaces, other snap and/or locking mechanisms, magnets as well as holes in the crown, as well as the two side chin areas to snap into male snaps by the wearer's chin areas thereby snapping in the faceguard into the helmet shell of the present invention using a magnet locking release system, which creates a more monolithic shape helmet incorporating the faceguard. The helmet shell of the present invention can have two injection molded or formed slide receiving areas that may be added post injection molding inside the shell to snap in the faceguard forehead area, shelves in tongue and groove method of fabrication to merge, as well as similar construct using prongs, shelves, snaps, etc. to merge the faceguard into the two chin areas.

In a preferred embodiment the outer shell contains air vent holes and ear port holes, but the entirety of the helmet shell has a smooth outer surface removing present or existing shell designs with indentations, angular shapes, carve-outs, etc. The outer shell is preferably shaped to include the ability to accommodate extensive and be not limited or restricted to address rotation of the helmet shell by providing the ability of the shell to independently and freely rotate separately with no attachments to the liner system, nor the wearer, and with the multiple degrees of freedom the helmet shell addresses rotational acceleration and velocity to incorporate the teachings of the '001 patent. In a preferred embodiment, the helmet shell has dimensions of approximately, but not limited to height 10.25 inches, depth 11 inches, from the chin to the back of the helmet 10 inches, brow depth of 3.25 inches, chin area recess depth 1.25 inches, and back of the helmet to the bottom edge of the chin area at 1.75 inches.

In a preferred embodiment, the air vents are strategically placed with multiple openings in the helmet shell to enhance the wearers ability to cool off in hot weather, and maximize the air flow into the helmet shell system even with minimal movement by the wearer.

In a preferred embodiment, the faceguard assembly will be lighter in weight via material use and is other than materials of the prior art. The faceguard assembly that is easily removable and easily connected, joined, merged at the brow area, as well as two chin areas that are snapped in, ratcheted in, secured in with prongs that snap in through an open passageway and/or open or closed shelves also prospectively using a spring latch, shelves, ratchet systems, or other securement methods is designed for strength, and designed to attach to the helmet shell without metal screws, bolts, or other obstructive attachments, and injection molded incorporated into the faceguard and into the helmet shell system—natural female/male snap in ability, as well as grooves located in the forehead or brow area with a ratchet system to secure the faceguard system to the helmet shell that will align/make flush the helmet shell with the faceguard, and the faceguard may also snap in via a cam action, or snap-in, shelf using a snap or ratchet system, or ratchet passageway system, or other methods to secure in the preferred embodiment, or the helmet shell and the faceguard will be exactly in line with each other making the helmet shell and faceguard system a more monolithic, and/or the brow area of the faceguard and the brow area of the helmet shell shall also meet to connect using a tongue and groove system, or unitized/as one contiguous helmet shell system covering the wearers entire head and face. This will not only eliminate metal bolts used in prior art as securement, but also will create a unitized/one helmet system. Prior art faceguards are still predominantly made out of steel covered in rubber weighing over one pound (~1.04 lbs.), being bolted in several places (forehead and side locations) to the helmet shell, have bars welded exteriorly over other bars that protrude, and are not smooth exteriorly, and which can catch or grab on articles of clothing, catch on the ground, etc., and with the added weight to the front of the helmet shell pull the helmet forward if not properly fitted and secured, which players do not consistently have their helmets properly fitted (you see may helmets easily flying off players during games). The preferred embodiment of the faceguard is to be continued use of polycarbonate materials, ABS, composites, overmolding or other materials that can take repetitive hits/impacts without denigrating the materials, and which helmet shells for football are manufactured today. The preferred embodiment may also incorporate different shapes and designs for the diameter and circumference of the individual "bars," or "rails," or "poles" of the faceguard. The preferred embodiment faceguard will have extended and injection molded "members," "arms," "prongs," emanating from the top and the two chin areas of the faceguard to slide into receiving grooves/paths inside the helmet shell located on the interior side of the helmet shell at the forehead or brow area, as well as the two chin areas. The preferred embodiment may also use snap holes at the lower portions of the faceguard will also be part of the injection molded process to leave open holes into the faceguard that will snap into two or more male extensions on each side of the wearer's chin area of the helmet shell using: snap rivet, R-loc, press snap fasteners, fixing rivets, so some form of snap method in the helmet shell on each side of the wearer's chin area. The preferred embodiment may also use a cam-action system. The faceguard will offer multiple shapes and designs that are easily interchangeable and may be swapped out typically based upon the wearer's playing position and selection. Due to materials use that are the same as the helmet shell, weight distribution will be more equal throughout the entirety of the helmet shell and will more proportionate. Finally, fit for the wearer, as well as less weight of the helmet shell will be improved.

In a preferred embodiment, the ear ports combine active noise cancelling to address and attenuate, reduce or potentially eliminate the overwhelming level or decibel loud level of crowd noise in all stadiums, whether indoor and outdoor that inhibits the ability of football and all sports players wearing helmets to hear their fellow players or teammates speaking on the field in-between the play and during play, and a design of the present invention to simultaneously with active noise cancellation emphasize directly into the wearer's ear the frequency and decibel level of the human voice in order to be able to hear on a playing field, and potentially with the military. The ear ports of the present invention address active cancellation of Hertz or frequency levels associated with crowd noise, as well as the decibel level that is a significant range typically between 90 to 125 dB created by crowds or audience during games. The ear ports of the present invention also address picking out or selecting out specific frequencies from a complex sound using a design of the present invention in the form of a Helmholtz resonator combined with a sea shell configuration.

In a preferred embodiment, the chin strap attaches to the inner liner system and/or the outer helmet shell of the helmet disclosed in the '001 patent or the outer helmet shell system in the '060 patent in four locations (or more or less than four), and the material of the strap itself and the chin cup is plastic, and/or material, and/or a composite or combination of materials of the prior art, but with possibly either some elastic stretch that is added to each strap starting immediately adjacent to the chin cup extending out for approximately 1-3 inches or more or in the preferred embodiment having the chin-straps permanently attached to the liner system using a center ratchet locking mechanism with quick release centered at the wearer's chin cup area to lock the chin strap.

The present invention provides a fully integrated helmet shell system in its entirety with the exception of the liner system. The helmet shell is designed to provide all interior and exterior aspects of the helmet system with exception of the liner system, and/or a radio system to communicate with the coaches and sidelines, and may incorporate all types of liner systems of the prior art. The present invention provides a completely integrated helmet system with the wearer's ability of the choice to use, apply or incorporate the lineage of available liner systems of the prior art in the marketplace today.

Four variants or embodiments of the helmet shell system address and include new air vents, new faceguard system and attachments, new ear port designs to concentrate on reducing frequency levels associated with crowd noise in stadiums, which is a current noted problem for auditory ability of sports players to hear on the field of play, and a new chin strap. Air vents are strategically placed with multiple openings in the helmet shell to enhance the wearer's ability to cool off in hot weather, and maximize the air flow into the helmet shell system with minimal movement by the wearer. Circulating fans and heating coils may also be added to the strategically placed air vents.

The faceguard assembly is designed for strength and designed to attach to the helmet shell in a preferred embodiment without metal screws, bolts, or other obstructive attachments, and injection molded incorporated into the faceguard and into the helmet shell system—natural female or male snap in ability, also with use of magnet securement system as well as grooves located in the forehead or brow area, plus the two chin areas with a ratchet system or magnet securement system or other securement systems to secure the faceguard system to the helmet shell that align or make flush the helmet shell with the faceguard, or the helmet shell and the faceguard in line or flush or even with each other making the helmet shell and faceguard system a more monolithic, or unitized or as one contiguous helmet shell system covering the wearers entire head and face. This preferably eliminates metal bolts as securement, but also creates a unitized/one helmet system.

The ear port design of the present invention addresses the decibel levels of a least 95 dBA up to, but not limited by 129 dBA typically associated with crowd frequency waves that drown out the ability of players to hear each other on the field of play. Crowd noise frequency waves tend to merge, which is called constructive interference when two waves are "in phase" from crowd noise, and when the two waves are out 11 of phase then it is called destructive interference (inverted wave versions of the ambient sound) and the two waves cancel each other out, which is the purpose of the new design of the present inventions ear ports. There is also combining of two waves to form a composite wave that is called: Interference. The interference is destructive if the waves tend to cancel each other. +=(Close to π out of phase) (Waves almost cancel) "destructive interference." Ear port shapes: Round, octagonal, triangular ear ports act like door openings in the helmet shell for sound frequency waves—diffraction of sound will occur due to if you are on the other side of an open door, or ear port, you could still hear the sound as it spreads out from the opening. But since there is minimal distance between the opening and the wearer's ear the diffraction is short lived, or does not have time to spread out over distance. You can hear lower frequencies better than high frequencies. Also high pitched sounds tend to be more directional because they don't diffract as much, or the long wavelengths of a bass drum versus a high pitched piccolo will diffract around the corner more efficiently than the more directional, short wavelength sounds of the higher pitched instruments. The average frequency range for human speech varies from 80 to 260 Hertz. The vocal speech frequency of an adult male ranges from 85 to 180 Hertz, while the frequency of an adult female ranges from 165 to 255 Hertz. Football has long had a number of issues with sound in stadiums, and not all stadiums are the same with different acoustic performance. Crowd noise is especially tough to address with covered or enclosed stadiums structures. The human ear can distinguish different pitches, frequencies, and loudness, and may also distinguish a difference of loudness between two noise sources when there is a 3 dBA (three decibels with a time weighted average) difference between them, and when the two sounds sources of the same pressure level and frequency are combined. The resulting level is twice as loud when the two sounds differ by 10 dBA. Add to this the reverberation effect, which time of reverberation varies with low, mid and high frequencies. Finally, addressing the ear port design is key to acceptance of different frequencies, which is where the resonance is important. The average sound intensity or noise levels recorded range for the majority of stadiums is 95 to peak 110 dBA, and up to 130 dBA—as an example a leaf blower equals 95-110 dBA, and jack hammer drills are 102-106 dBA, jet engine is 175 dB, shot gun is 175 dB, and at 190 dB sound waves become shock waves, so it is clear stadiums are noisy. 115 dBA can damage a fan's hearing if exposed for any length of time. The NFL has placed noise restriction rules into their game with compliance required for crowd noise. Open roof top stadiums have lower "RT" or reverberation time at lower frequencies than closed roof stadiums. The open-air stadium versus closed-air stadiums that often have reverberation times exceeding 10 seconds, which makes speech difficult to understand. Reducing the unwanted sound is incumbent upon designers to shape, address angle, and treat surfaces. As an example, Kansas City's Arrowhead Stadium, home of the NFL Chiefs took it up another notch or two, pushing the new record to 137.5 decibels in the closing moments of the Chiefs' 24-7 victory over the Oakland Raiders. The noise routinely wreaks havoc on opposing offenses as quarterbacks struggle to call plays or "audibles" at the line of scrimmage without the use of non-verbal communication. Offenses are often baited into false-start and delay-of-game penalties due to the noise at CenturyLink Stadium home of the Seattle Seahawks.

It will be appreciated that noise cancellation is available in two categories—Active and Passive noise cancellation. The Passive noise cancellation works by blocking some frequencies of sound waves. Noise or sound, is a wave, and like any wave except a pure sinusoidal one, a wave can itself be reproduced as the combination of other waves, called the principle of superposition. Noise can be produced as the sum of other waves, two, three or an infinite number. Sound travels in waves with a frequency measured in Hertz with one wave is both the up and the down halves or crests. People can hear between 20-20,000 Hertz. Waves have amplitudes, which measures the wave's strength switching between positive and negative with each cycle. Waves are called periodic functions and period and frequency are related. Waves combine when amplitudes of two waves have the same sign (+/−) and they will meld together to form a wave with a larger amplitude, which is called constructive interference. If the two amplitudes have opposite signs then they will subtract to form a combined wave with lower amplitude called destructive interference. Two waves that add together may have different frequencies with crests and troughs not the same, and part of the waves will interfere constructively and part will interfere destructively, which equates to a beat in music, and piano tuners strike a tuning fork then play a note on the piano and tightens or loosens the strings until the beat disappears.

It will be appreciated by those of ordinary skill in the art that Helmholtz resonance or wind throb is the phenomenon of air resonance in a cavity, such as when one blows across the top of an empty bottle. The name comes from a device created in the 1850's by Hermann von Helmholtz, the Helmholtz resonator, which is used to identify the various frequencies or musical pitches present in music and other complex sounds, and in his book "On the Sensations of Tone," an apparatus is able to pick out specific frequencies from a complex sound. The Helmholtz resonator, consists of a rigid container of a known volume, nearly spherical in shape, with a small neck and hole in one end and a larger hole in the other end to emit the sound. When the resonator's 'nipple' is placed inside one's ear, a specific frequency of the complex sound can be picked out and heard clearly. Apply a resonator to the ear, most of the tones produced in the surrounding air will be considerably damped; but if the proper tone of the resonator is sounded, it brays into the ear most powerfully. An adjustable universal resonator consists of two cylinders, one inside the other, which can slide in or out to change the volume of the cavity over a continuous range. An array of 14 of this type of resonator has been employed in a mechanical Fourier sound analyzer. This resonator can also emit a variable-frequency tone when driven by a stream of air in the "tone variator" invented by William Stem, 1897. When air is forced into a cavity, the pressure inside increases. When the external force pushing the air into the cavity is removed, the higher-pressure air inside will flow out. Due to the inertia of the moving air the cavity will be left at a pressure slightly lower than the outside, causing air to be drawn back in. This process repeats, with the magnitude of the pressure oscillations increasing and decreasing asymptotically after the sound starts and stops. The port (the neck of the chamber) is placed in the external meatus of the ear, allowing the experimenter to hear the sound and to determine its loudness. The resonant mass of air in the chamber is set in motion through the second hole, which is larger and doesn't have a neck. A gastropod seashell can form a low Q Helmholtz resonator, of which the present invention will apply amplifying many frequencies. Using an empty bottle, the length and diameter of the bottle neck also contribute to the resonance frequency and its Q factor. By one definition a Helmholtz resonator augments the amplitude of the vibratory motion of the enclosed air in a chamber by taking energy from sound waves passing in the surrounding air. In the other definition the sound waves are generated by a uniform stream of air flowing across the open top of an enclosed volume of air.

It will be appreciated by those of ordinary skill in the art that sound propagates through air as a longitudinal wave. The speed of sound is determined by the properties of the air, and not by the frequency or amplitude of the sound. Sound waves, as well as most other types of waves, can be described in terms of the following basic wave phenomena: speed of sound, sound pressure, sound intensity, reflection, refraction, diffraction and interference. Sound and hearing are regulated by: hearing, pitch, loudness, timbre, and the effects noted above. Bass frequencies have longer wavelengths than high frequencies. Sound really moves, and under normal conditions a wavefront moves through air at 1,130 feet per second—the speed of sound.

It will be appreciated by those of ordinary skill in the art that Hertz is the unit used to measure frequency typically one cycle per second. To understand the meaning of hertz properly, one must first understand Frequency. Functions such as amplitude modulation can have double periods. They are periodic functions encapsulated in other periodic functions. The inverse of the frequency of the periodic motion gives the time for a period. The unit hertz is named to honor the great German physicist Heinrich Hertz. The dimensions of hertz are per time ($T^{-1}$). Hertz is the SI unit for measuring frequency. The base unit of decibel is "bel," which is a very rarely used unit. The unit decibel is directly connected to the intensity of a wave. The intensity of a wave at a point is the energy carried by the wave per unit time per unit area at that point. The unit decibel is used to measure the intensity level of a wave. The decibel value is the logarithmic ratio of the intensity of the wave to a certain reference point. For the sound waves, the reference point is 10-12 watts per square meter. This is the minimum hearing threshold of the human ear. The sound intensity level at that point is zero. Decibel is a very useful mode when it comes to fields such as amplifiers. This method can be used to convert multiplications and ratios into subtractions and additions.

It will be appreciated by those of ordinary skill in the art that active noise control (ANC), also known as noise cancellation, or active noise, which will be employed in the present invention, reduction (ANR), is a method for reducing unwanted sound by the addition of a second sound specifically designed to cancel the first. Sound is a pressure wave, which consists of alternating periods of compression and rarefaction. A noise-cancellation speaker emits a sound wave with the same amplitude but with inverted phase (also known as antiphase) to the original sound. The waves combine to form a new wave, in a process called interference, and effectively cancel each other out—an effect which is called destructive interference. Modem active noise control is generally achieved through the use of analog circuits or digital signal processing. Adaptive algorithms are designed to analyze the waveform of the background aural or nonaural noise, then based on the specific algorithm generate a signal that will either phase shift or invert the polarity of the original signal. This inverted signal (in antiphase) is then amplified and a transducer creates a sound wave directly proportional to the amplitude of the original waveform, creating destructive interference. This effectively reduces the volume of the perceivable noise. A noise-cancellation speaker may be co-located with the sound source to be attenuated. In this case it must have the same approximate audio power level as the source of the unwanted sound. Alternatively, the transducer emitting the cancellation signal may be located at the location where sound attenuation is wanted (e.g. the user's ear). This requires a much lower power level for cancellation but is effective only for a single user.

It will be appreciated by those of ordinary skill in the art that noise control is an active or passive means of reducing sound emissions, and active noise control is sound reduction using a power source. Wave interference and beat frequency with the equations of these lines are: y1=sin(2πf1t)y1=sin(2πf1t) and y2=sin(2πf2t)y2=sin(2πf2t). Where the frequencies of each wave are f1f1 and f2f2 respectively, and tt is the time. These two waves oscillate between −1 and 1. The two waves come closer together they may be mathematically speaking, this can be written as:

$$y1+2-y1+y2=\sin(2\pi f1t)+\sin(2\pi f2t)y1+2-y1+y2=\sin(2\pi f1t)+\sin(2\pi f2t)$$

When f1f1 and f2f2 are quite close together, it becomes hard to hear two distinct notes, and instead they seem to merge into one note, such as crowd noise, but with the volume oscillating up and down—this phenomenon is known as a beat, and the frequency at which the sound oscillates in amplitude is known as the "beat frequency." In mathematical terms by considering the trigonometric identity: sin(x)+sin(y)=2 sin(x+y2)cos(x−y2)sin(x)+sin(y)=2 sin(x+y2)cos(x−y2) that may be rewritten as the equation for y1+2y1+2 as a product instead of a sum y1+2=2 sin[2πf1+f22t]cos[2πf1−f22t]y1+2=2 sin [2πf1+f22t]cos[2πf1−f22t] This equation shows that y1+2y1+2 is equivalent to a sine wave with a frequency of the average of f1f1 and f2f2 multiplied by another term with a frequency of half of the difference of f1f1 and f2f2. It is this second term that is responsible for the beating effect, and is known as an envelope. It's worth pointing out that there are two times that the envelope passes through zero for every wavelength, so the beat frequency is twice the frequency of the envelope and is given by the magnitude of the difference of the two frequencies. fbeat=|f1−f2|fbeat=|f1−f2|.

It will be appreciated by those of ordinary skill in the art that, simply put, noise is any sound one does not want to hear. Measured in decibels (a 10 dB increase in sound corresponds to a tenfold increase in sound pressure and energy, with 0 dB the human auditory threshold), a beautiful countryside with only natural sounds has a sound level in the range of 10 to 20 dB. In a bedroom having sound levels above 45 dB, most people will experience considerable difficulty in getting to sleep and staying asleep. Use of sound-blocking metamaterial that has continuous paths of the present invention allows the passage of air by using Helmholtz resonators. Each set has different internal dividers that break the inner air space into one, two, or four equal-sized volumes. The dividers serve to change the resonant frequencies so that a wider frequency band can be silenced. In all cases a cylindrical air filter is inserted through the air hole to prevent the usual Helmholtz resonator whistle. When sound passes through the air holes, the sound waves are strongly diffracted into the entire volume of the diffraction resonator, so that very little of the sound can pass directly through the air holes. The other part of the answer is that the diffraction resonators cause the air to have negative compressibility over a fairly wide frequency band. Normal sound waves in air are made up of a series of compressed and expanded regions. The energy of the compressed air drives that material to expand, and vice versa. However, when compressibility is negative, compressed air is less dense than air at lower pressure. As a result, compressed air does not expand, which is the mechanism that normally allows sound waves to travel through materials. Instead, sound waves are strongly attenuated as they travel through a material with negative compressibility. The combination of these two effects defines a frequency band within which sound passing through the window is strongly attenuated. Prototype window designs for testing sound attenuation properties. The test results showed that the window with the 0.8-in air holes reduced sound transmission by over 30 dB at frequencies from 200 to nearly 5,000 Hz, with over 20 dB attenuation even at very low frequencies. The window with 2-in air holes was intended as a compromise between sound attenuation and air passage. This window produced similar attenuation to that of the 0.8-in window for frequencies between about 700 and 2,000 Hz, with attenuation in excess of 15 dB for frequencies from 600 and 5,000 Hz.

It will be appreciated by those of ordinary skill in the art that the shape of a pipe has a large effect on the spreading of particles suspended in the fluid flowing through the pipe. Calculations show that round pipes produce symmetrical spreading along the flow direction, whereas rectangular pipes give an asymmetry. New calculations of the spreading of particles being carried down a pipe by a fluid show that the effect of the pipe shape-round versus rectangular-is more dramatic than researchers previously thought. The particles spread out asymmetrically in a rectangular pipe, whereas they form a symmetric distribution in both circular and elliptical pipes. Surprisingly, the cross section that reproduces the symmetrical behavior of a circular pipe is not a square but a rectangle with approximately a 2 to 1 width-to-height ratio. The researchers are unable to provide a simple physical explanation, but they believe the results may help in optimizing conduit shapes for drug delivery or for chemical reaction vessels.

In a preferred embodiment, the chin strap of the helmet shell of the present invention includes a chin strap that secures via and has a stretch mechanism in the straps to allow rotation of the helmet shell incorporating the helmet of the '001 patent in the inner liner system, and potentially the outer shell, as well as, or in the preferred embodiment having the chin-straps permanently attached to the liner system using a center ratchet locking mechanism with quick release centered at the wearer's chin cup area to lock the chin strap.

In a preferred embodiment, the present invention is a helmet shell assembly that generally includes air vent holes, a faceguard, a faceguard snap-in capability and receiving channel snap-in, two ear port holes, an ear port assembly with transmitters, microphones, chip and battery, cochlear or seal shell resonance design, and a chin strap assembly. In an embodiment, the helmet shell contains more than one air vent of different designs, locations and configuration. The helmet assembly includes a faceguard assembly with snap-in locations near the wearer's chin area, as well as the two receiving areas for the faceguard prongs in the forehead or brow area on the front of the helmet shell. The helmet assembly in an embodiment can include a faceguard system of one design with the two prongs located at the top of the faceguard and the holes to snap-in the faceguard in the two areas of the wearer's chin, or each side of the face or chin area. The helmet assembly in an embodiment can include a faceguard system of one design with the two prongs located at the top of the faceguard snap-in area and the buckle or ratchet system, the faceguard, and the holes to snap-in the faceguard in the two areas of the wearer's chin or each side of the face or chin area.

The helmet assembly in an embodiment can include a faceguard system of one design with the two prongs located at the top of the faceguard, snap-in area and the buckle or ratchet system, the faceguard, and the holes to snap-in the faceguard in the two areas of the wearer's chin or each side of the face or chin area. The helmet assembly in an embodiment can include a faceguard system of one design having noise protection with the two prongs located at the top of the faceguard and the holes to snap-in the faceguard in the two areas of the wearer's chin, or each side of the face or chin area. The helmet assembly in an embodiment can include a faceguard system of one design with the two prongs receiving openings or channels located at the top of the faceguard, and the male version of the snap-in area to fit the holes of the faceguard holes to snap-in the faceguard in the two areas of the wearer's chin or each side of the face or chin area.

The helmet assembly in an embodiment can include two ear port openings or holes located over the wearer's ear areas that address crowd noise or frequency attenuation using an ear port assembly with transmitters, receivers, microphones, capacitor, chip and battery, and cochlear resonance design. The helmet assembly in an embodiment can include two ear port openings or holes located over the wearer's ear areas that address crowd noise or frequency attenuation using an ear port assembly with transmitters, microphones, chip and battery, and cochlear resonance design. Modem active noise control is generally achieved through the use of analog circuits or digital signal processing. Adaptive algorithms are designed to analyze the waveform of the background aural or nonaural noise, then based on the specific algorithm generate a signal that will either phase shift or invert the polarity of the original signal. This inverted signal (in antiphase) is then amplified and a transducer creates a sound wave directly proportional to the amplitude of the original waveform, creating destructive interference. This effectively reduces the volume of the perceivable noise.

A noise-cancellation speaker may be co-located with the sound source to be attenuated. In this case it must have the same audio power level as the source of the unwanted sound in order to cancel the noise. Alternatively, the transducer emitting the cancellation signal may be located at the location where sound attenuation is wanted (e.g. the user's ear). This requires a much lower power level for cancellation but is effective only for a single user. Noise cancellation at other locations is more difficult as the three-dimensional wavefronts of the unwanted sound and the cancellation signal could match and create alternating zones of constructive and destructive interference, reducing noise in some spots while doubling noise in others.

In another embodiment, the chin strap assembly includes elastic areas on the straps.

In a preferred embodiment, the present invention is a complete helmet shell and faceguard assembly system that includes a helmet shell that defines an interior and an exterior containing openings, a helmet shell assembly with openings for multiple air vents, a helmet shell assembly that includes a faceguard or mask that snaps into and connects or unites with the helmet shell in the front opening or area of the helmet shell. The helmet shell assembly preferably includes two ear port openings located over the wearer's ear areas that address crowd noise or frequency attenuation. The helmet shell assembly preferably includes a chin strap assembly that attaches or secures to the outer helmet shell, a complete helmet shell assembly or unit with an open area in the face area of a helmet shell where the faceguard assembly that is removable from a closed position with the helmet shell assembly when it is snapped into grooves and holes in the helmet shell, and where the helmet shell and faceguard assembly when snapped in the helmet shell are one unit or contiguous, or more monolithic as one unit, and ear ports or openings over the wearers ear areas that are designed and configured to reduce crowd noise Hertz frequency and decibel levels, so helmet shell wearers may hear other players at specified decibel and frequency levels with them on the field of play in football and other sports, which are different Hertz and decibel levels and a chin strap assembly that attaches to the outer shell that this new design will accommodate the helmet taught in the '001 patent and its ability to rotate the helmet shell independent of the wearer without obstruction or limitation for multiple degrees of helmet shell rotational freedom. The helmet shell assembly preferably includes openings for air vents, ear ports, the face of the wearer, and to snap in the chin strap, and the helmet shell assembly includes a faceguard, two ear port assemblies, a chin strap assembly configured to secure the helmet shell from an unfastened to a secure fastened position.

In a preferred embodiment, the multiple air vents assembly are positioned or located throughout the helmet shell in order to achieve maximum inflow and outflow of air for cooling and heat to be radiated from the wearer and exited out through the air vents leaving the helmet shell system. Preferably, the helmet shell assembly includes a faceguard or mask that snaps into and connects or unites flush or exactly even with the helmet shell in the entirety of the front opening or area of the helmet shell. In a preferred embodiment, helmet shell assembly includes a faceguard or mask that snaps into and connects or unites flush or exactly even with the helmet shell in the entirety of the front opening or area of the helmet shell, and in a preferred embodiment, the faceguard assembly is lighter in weight via material use and is other than materials of the prior art. The faceguard assembly that is easily removable and easily snapped in, is designed for strength, and designed to attach to the helmet shell without metal screws, bolts, or other obstructive attachments, and injection molded incorporated into the faceguard and into the helmet shell system—natural female or male snap in ability, as well as grooves located in the forehead or brow area with a ratchet system or cam action to secure the faceguard system to the helmet shell that aligns or makes flush the helmet shell with the faceguard, or the helmet shell and the faceguard are in line with each other making the helmet shell and faceguard system a more monolithic, or unitized or as one contiguous helmet shell system covering the wearers entire head and face.

In a preferred embodiment, the ear parts include active noise cancelling to address and attenuate or reduce or potentially eliminate the overwhelming level or decibel loud level of crowd noise in stadiums, whether indoor and outdoor that inhibits the ability of football and all sports players wearing helmets to hear their fellow players or teammates speaking on the field in-between the play and during play. The ear ports of the present invention address Hertz or frequency levels associated with crown noise, as well as the decibel level that is a significant range typically between 90 to 125 dB created by crowds or audience during games. The ear ports of the present invention also address picking out or selecting out specific frequencies from a complex sound using anew design of the present invention in the form of a Helmholtz resonator combined with a sea shell configuration.

In a preferred embodiment, the helmet shell assembly includes a chin strap assembly that attaches or secures to the outer helmet shell. In a preferred embodiment, the chin strap attaches to the exterior of the helmet shell in four locations, and the material of the strap itself and the chin cup will continue to be plastic, and/or material, and/or a composite or combination of materials of the prior art, but with the exception of the elastic stretch that is added to each strap starting immediately adjacent to the chin cup extending out for approximately one inch, or two inches, or three inches, or a length therein.

In a preferred embodiment, the present invention provides a fully integrated helmet shell system in its entirety with the exception of the liner system. The new helmet shell is designed to provide all interior and exterior aspects of the helmet system with exception of the liner system, and/or a radio system to communicate with the coaches and sidelines, and may incorporate all types of liner systems of the prior art. The goal is to provide a completely integrated helmet system with the wearer's ability of the choice to use, apply or incorporate the lineage of available liner systems of the prior art in the marketplace today.

In a preferred embodiment, the present invention is a helmet shell assembly that includes a helmet shell system that defines an interior and exterior that includes multiple openings, a helmet shell that defines an interior and an exterior containing openings, and a shelf to snap in the faceguard. The helmet shell defines an interior and an exterior containing openings, two receiving grooves or channels for the faceguard assembly and prongs or arms. The helmet shell assembly includes openings for multiple air vents, a helmet shell assembly that includes an opening for the faceguard or mask that snaps into and connects or unites with the helmet shell in the front opening or area and sides of the helmet shell. The helmet shell assembly incorporates the opening area for the face to include a faceguard.

The faceguard system includes prongs to enter into a helmet shell receiving system in the crown area of the helmet shell starting at the forehead or brow area of the helmet shell, and/or holes on each side of the faceguard near the wearers' chin are to snap into the helmet shell into a snap system with a male snap, and/or a faceguard system that is using the same materials as the helmet shell, or polycarbonate or ABS, and/or a faceguard system that when properly secured sits flush, or exactly aligned with the helmet shell system. A faceguard system that includes a magnet securement system on each side of the faceguard near the wearers' chin are to snap into the helmet shell into a snap system with a magnet securement system The helmet shell assembly includes two ear port openings located over the wearer's ear areas that address crowd noise or frequency attenuation, an ear port assembly or system that includes an active noise cancellation system, an ear port assembly or system that includes a Helmholtz resonator system, an ear port assembly or system that includes a the sea shell construct, an ear port system that includes metamaterials for sound attenuation, an ear port system that includes an opening to the wearer's ears, and/or a helmet shell assembly that includes a chin strap assembly that attaches or secures to the outer helmet shell.

In a preferred embodiment, the helmet shell assembly and the faceguard system include prongs located at the top of the faceguard snap-in area and use a magnet system and receiving grooves as part of a magnet securement system. The wing members can also include a chin snap-in areas magnet securement system.

The faceguard system can include nose protection with the two prongs located at the top of the faceguard and the holes to snap-in the faceguard in the two areas of the wearer's chin, or each side of the face/chin area.

In a preferred embodiment, the helmet shell assembly includes two ear port openings or holes located over the wearers ear areas that address crowd noise and/or frequency attenuation using an ear port assembly with transmitters, microphones, a chip and a battery, and can employ a cochlear resonance design.

In a preferred embodiment, the helmet assembly 10 includes a chin strap assembly with an elastic area or portion on the straps so that when the helmet shell or outer shell rotates or moves, the straps can stretch.

In a preferred embodiment, the helmet shell assembly includes a compression impact and health data sensor capture technology systems. An at compression data sensor capture technology system device to be used for sports activities, military use, and construction or industrial use is described—impact force is taken at initial impact or compression at the impact's peak severity versus in tension at the wearer's head. Three impact engaging members housing the hardware, code, mother board, software, algorithms, accelerometers, gyros, g-force capture, health capture capabilities of key pertinent medical data usually taken at an emergency room or a doctor's office of the sensor(s) are designed with use of the aforementioned prior art patents with proven ability to read, capture and transmit health data, plus be able to read, capture, and transmit impact force taken at the point of impact or at compression versus in tension coupled with sensor(s) designed to read bio-metric vitals.

BRIEF DESCRIPTION OF THE DRAWINGS

Like numerals refer to like parts throughout the several views of the drawings.

DETAILED DESCRIPTION OF THE PREFERRED EMBODIMENTS

Figure 1:
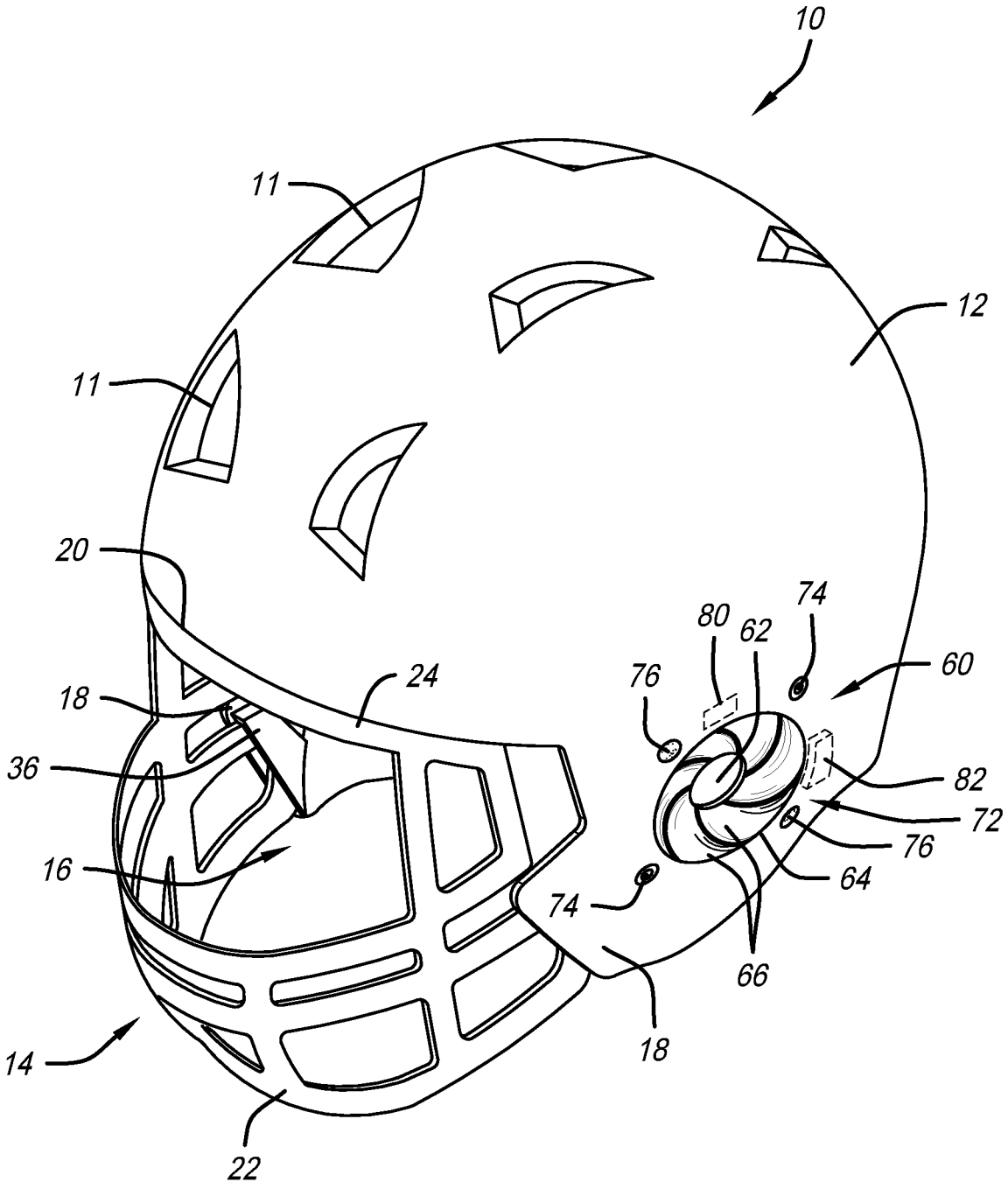
FIG. 1 is a perspective view of a helmet assembly in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It may be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, may control.

It may be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Referring now to the drawings, wherein the showings are for purposes of illustrating the present invention and not for purposes of limiting the same, FIGS. 1-10 show embodiments of a helmet, helmet system or helmet assembly 10 that, in a preferred embodiment, includes openings for air vents 11 defined in a helmet shell 12 and that includes a faceguard or mask 14 that snaps into and/or connects, unites or is secured with or to the helmet shell 12 or the inner liner in the front opening area of the helmet shell 12 or inner liner. The helmet assembly 10 also preferably includes two ear port openings or holes located adjacent or over the wearer's ear areas and that address crowd noise and/or frequency attenuation.

FIG. 1 shows the helmet shell assembly 10. It will be appreciated that the helmet shell assembly can include the magnetic suspension system disclosed in the '001 patent, thereby requiring an outer helmet shell and an inner liner. In another embodiment, the magnetic suspension system can be omitted.

As shown in FIGS. 1-4, in a preferred embodiment, the helmet shell assembly 10 includes the helmet shell 12 and a faceguard 14. The helmet shell includes a face or front opening 16, first and second chin projections 18, an inner surface 12*a* and an outer surface 12*b*. The front opening 16 is at least partially defined by a forehead edge 20 and the inner edges of the first and second chin projections 18.

Figure 2:
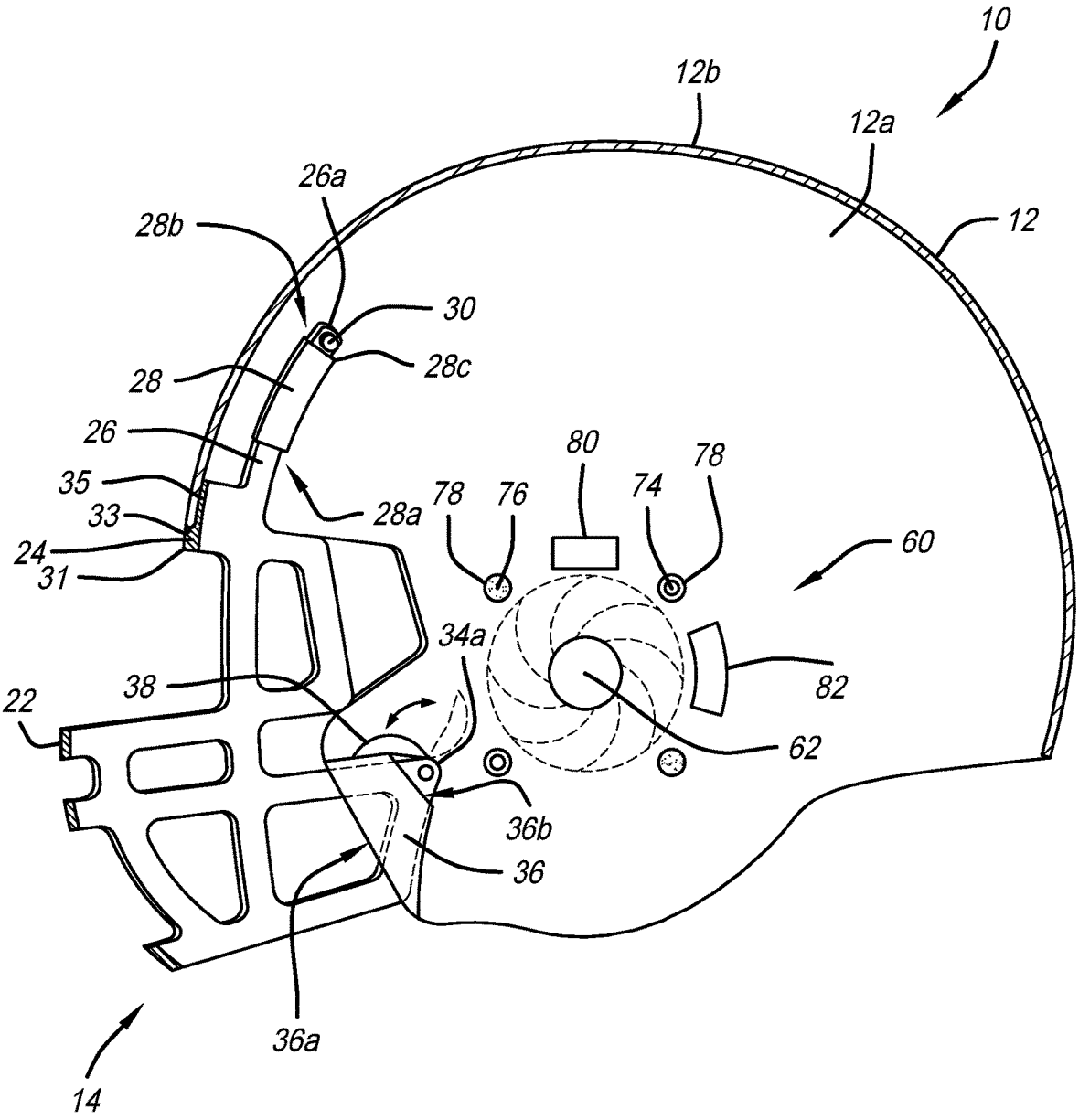
FIG. 2 is a cross-sectional view of the helmet assembly of FIG. 1.
Figure 3:
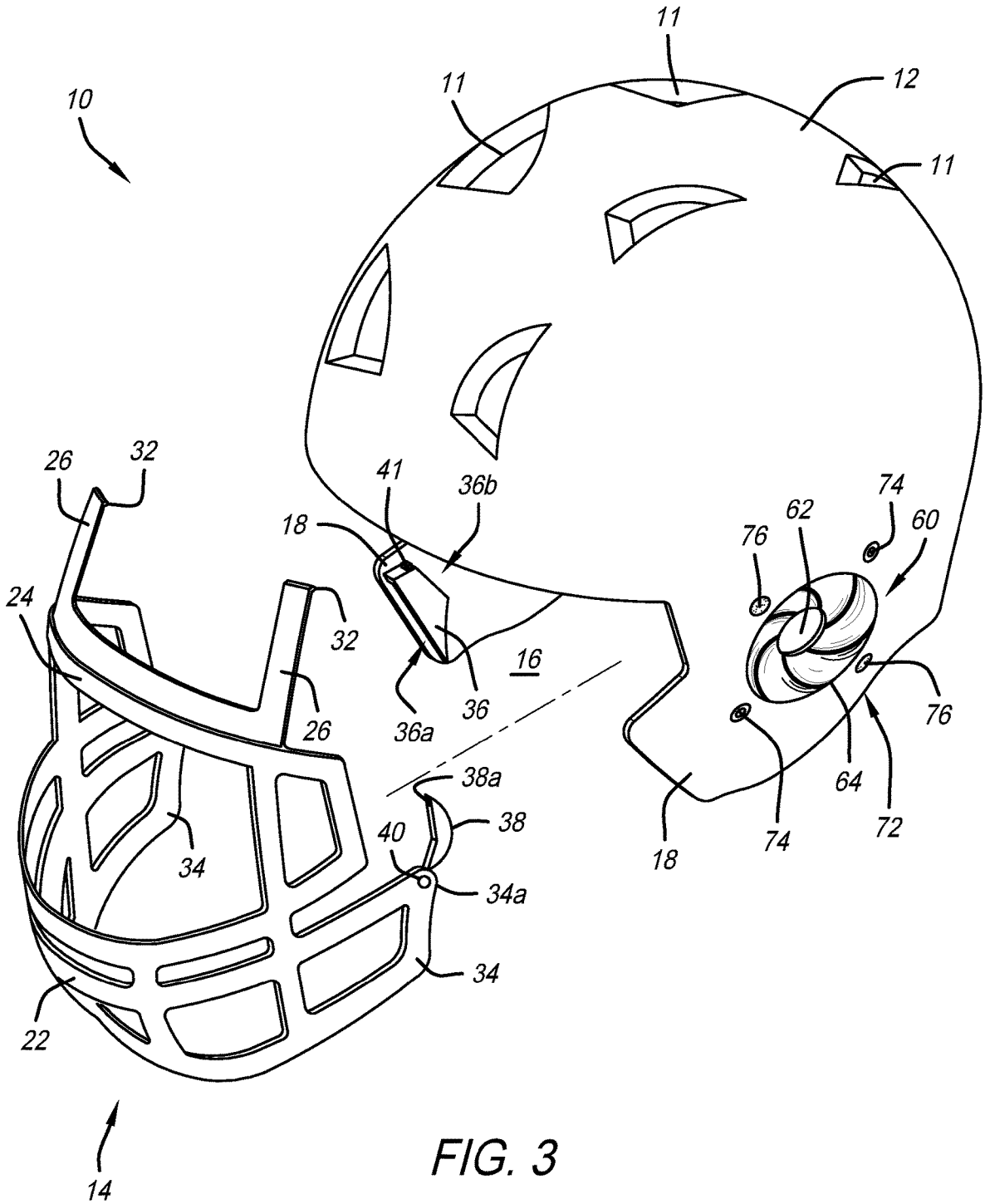
FIG. 3 is an exploded view of the helmet assembly of FIG. 1.

The faceguard 14 includes a lower section 22 and an upper section 24. As shown in FIGS. 2-3, the upper section 24 includes first and second prong members 26 extending upwardly therefrom that are removably received in a secured position in first and second tunnel members 28 that are positioned on, secured or attached to the inner surface 12*a* of the helmet shell 12. The first and second tunnel members 28 each include an entry opening 28*a* and an exit opening 28*b*. In a preferred embodiment, in the secured position, the distal ends 26*a* of the first and second prong members 26 are located outside of the tunnel members. In other words, when the prong members 26 are inserted into the tunnel members 28, the distal end of the prong member 26 is inserted through the entry opening 28*a* and through the exit opening 28*b* where it is secured. In another embodiment, the distal end 26*a* of the prong member can remain inside the tunnel member 28 and can be secured therein.

In a preferred embodiment, prong members 26 are latched, locked or secured in place in the secured position such that they cannot be removed from the tunnel members 28. FIG. 2 shows an outwardly biased button 30 on the distal end 26*a* of the prong member 26. The button 30 can be depressed or pushed inwardly prior to or while entering the entry opening 28*a* and then is biased outwardly to the locking position as the distal end 26*a* exits the tunnel member 28 to secure the prong member in the secured position. It will be appreciated that the button 30 is biased outwardly and prevents the prong member from being pulled back through the tunnel member 28 because the button contacts the upper edge of the tunnel member 28 (referred to herein as the "stop edge" 28*c*). To remove the prong member from the tunnel member, the button 30 is depressed or pushed inwardly so that it clears the stop edge 28*c* of the tunnel member 28 and the prong member 26 is pulled back through the tunnel member and out of the entry opening 28*a*. In a preferred embodiment, the entry opening 28*a* is taller has a larger height dimension than the exit opening 28*b*. In this embodiment, the entry opening 28*a* has a larger height dimension (is higher than the height of the button 30 in the biased outwardly locking position). Therefore, the button 30 does not need to be depressed by the user when inserted into the tunnel member. Instead, the button enters the tunnel member and is pressed downwardly as is travels therethrough and then "pops up" or is biased outwardly as it enters the exit opening 28*b* (which has a shorter or smaller height than the entry opening). This may be referred to herein as a declining upper surface. In removing the faceguard, the user pushes button 40 first to release latch member 38 and then releases the prong members 26.

Any type of latching of locking system for allowing the prong member to be removably received in the tunnel member is within the scope of the present invention. For example, a ratchet system, one or more teeth, cams, one or more pawls, hooks, snaps, magnets, detents and the like can be utilized. FIG. 3 shows a tooth 32 on the distal end 26*a* of the first and second prong members 26. Due to the curved shape of the prong member 26 and the material from which is made, the tooth 32 is biased outwardly such that when it exits the exit opening 28*b* and clears the stop edge 28*c* it moves outwardly and contacts the stop edge 28*c*. To remove the prong member 26 from the tunnel member, the distal end of the prong member 26 is pushed inwardly so the tooth clears the stop edge 28*c* and the prong member is pulled back through the tunnel member. All of the latching, locking or securement systems discussed herein or others known by persons of ordinary skill in the art are referred to herein as a securement system (for securing the faceguard in place near the forehead edge and on the chin projections. The securement system secures the prongs in the secured position and allows the user to take some releasing action so that the prong can be removed from the tunnel member.

In a preferred embodiment, the first and second prong members 26 are curved such that when they are inserted into the tunnel members 28, they follow the contour or curvature of the inner surface 12*a* of the helmet shell (within the tunnel member) or other surface on which the tunnel members are positioned (also referred to as the bottom surface of the tunnel member). The tunnel members 28 are preferably also curved.

The combination of the prong members being secured in the tunnel members and the associated components may be referred to herein as an upper faceguard securement system.

As shown in FIG. 2, in a preferred embodiment, a portion of the helmet shell and the forehead edge are received in a groove 33 that is defined in the upper bar 31 of the upper section 24 of the faceguard 14 (a tongue and groove relationship). The groove 33 is at least partially defined by a shelf or extension member 35 that extends upwardly from the upper bar 31. The front surface of the extension member 35 contacts the inner surface of the helmet shell 12.

Figure 4:
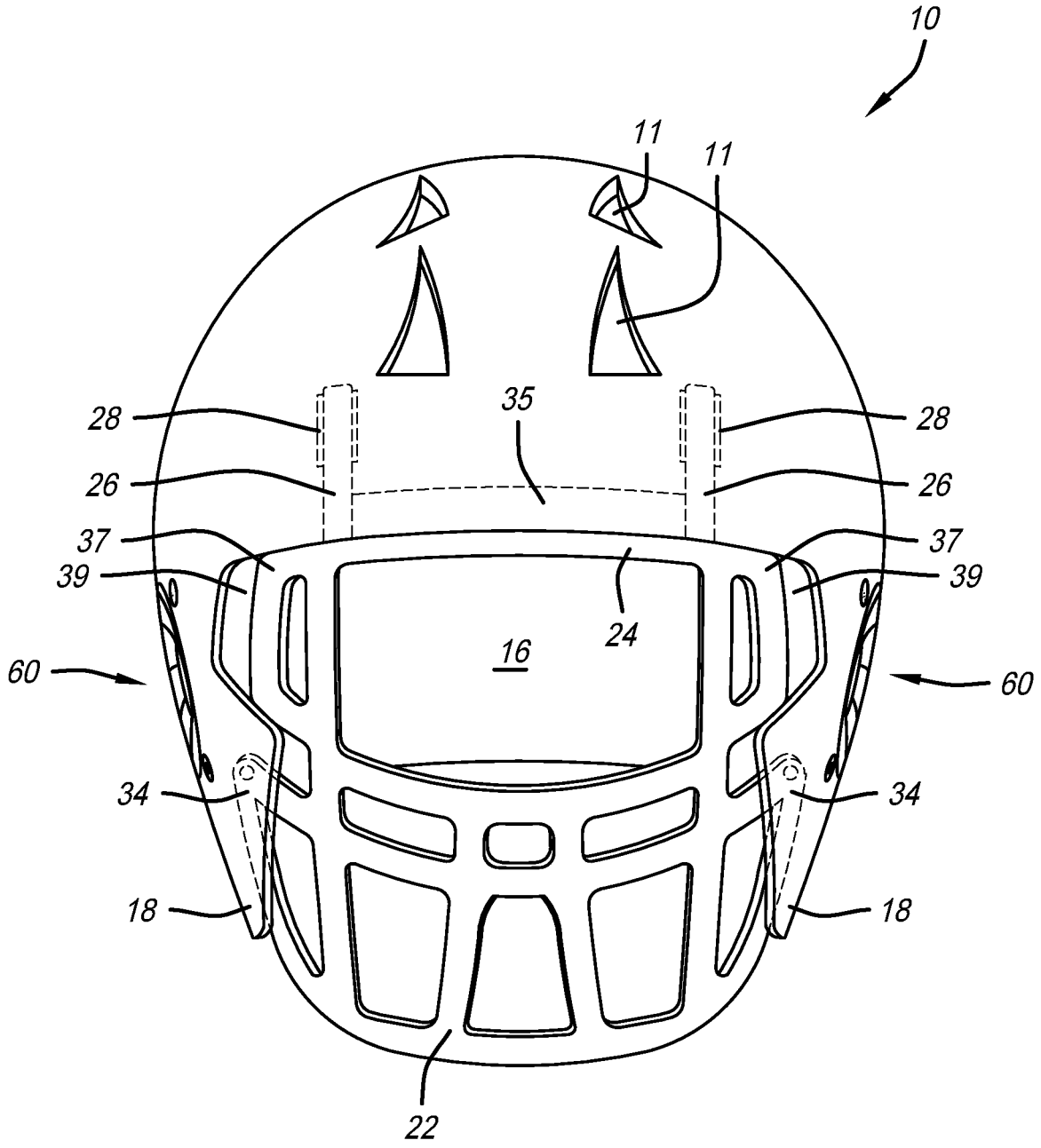
FIG. 4 is a front elevational view of the helmet assembly of FIG. 1.

As shown in FIG. 4, the upper section 24 of the faceguard preferably includes first and second side projections 37 that extend into side recesses 39 defined in the helmet shell. The side recesses 39 are part of the front opening 16.

As shown in FIGS. 3-4, the lower section 22 of the faceguard 14 includes first and second wing members 34 extending therefrom that are removably received in a secured position in first and second receiving members 36 that are that are positioned on, secured or attached to the inner surface 12*a* of the helmet shell 12 at a location on the first and second chin projections 18. In another embodiment, the first and second receiving members 36 can be secured to another component, such as the inner liner. The first and second receiving members 36 each include an entry opening 36*a* and an exit opening 36*b*. In a preferred embodiment, in the secured position, the distal ends 34*a* of the first and second wing members 34 are located outside of the receiving members. In other words, when the wing members 34 are inserted into the receiving members 36, the distal end of the wing member 34 is inserted through the entry opening 36*a* and through the exit opening 36*b* where it is secured. In another embodiment, the distal end 34*a* of the wing member 34 can remain inside the receiving member 36 and can be secured therein.

Figure 5:
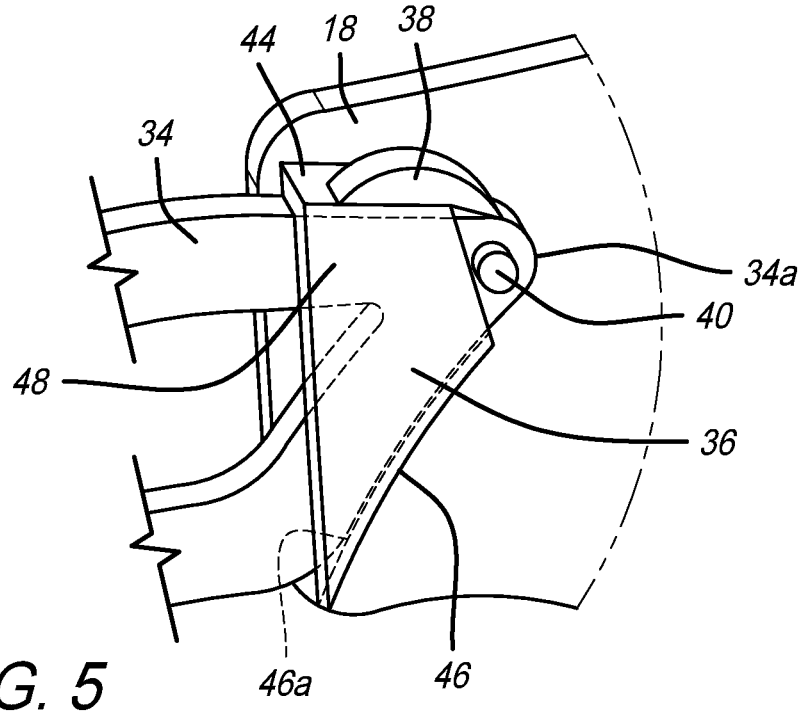
FIG. 5 is a cut away view of a faceguard attachment system in accordance with a preferred embodiment of the present invention.

In a preferred embodiment, wing members 34 are latched, locked or secured in place in the secured position such that they cannot be removed from the receiving members 36. FIGS. 2 and 5 shows a pivotable latch member 38 on the distal end 34*a* of the wing member 34. The latch member 38 can be pivoted between an unlatched position (see the dashed lines in FIG. 2) and a latched position (see the solid lines in FIG. 2) where it is latched or secured to the receiving member 36. In use, the latch member 38 is in the unlatched position when entering the entry opening 36*a*, moving through the receiving member 36 and exiting the exit opening 36*b*. The latch member 38 is then pivoted to the latched position where it is secured to the upper wall or other portion of the receiving member 36. It will be appreciated that when the latch member is in the latched position, the wing member 34 is prevented from being pulled back through the receiving member 36. To remove the wing member from the receiving member, the latch member 38 is unlatched by pressing button 40 (which can be located on the wing member or the receiving member). The wing member is then pulled back through the receiving member and out of the entry opening 36*a*. The receiving members 36 can include a declining upper surface (similar to the declining upper surface described above) where the entry opening 36*a* has a larger height dimension (is higher than the height of the button 40 in the biased outwardly position). FIG. 3 shows an exemplary latching system for the latch member 38. As shown, the latch member 38 includes an opening 38*a* therein that can be received on a post 41 on the top wall 44 of the receiving member 36.

Any type of latching of locking system for allowing the wing member to be removably received in the receiving member is within the scope of the present invention. For example, an outwardly biased button or tooth, similar to those described above can also be used to secure the wing members in the secured position. In other embodiments, a ratchet system, one or more teeth, one or more pawls, hooks, snaps, detents and the like can be utilized. All of the latching or locking systems discussed herein or others known by persons of ordinary skill in the art are referred to herein as a latching system. The latching system secures the wing members in the secured position and allows the user to take some releasing action so that the wing member can be removed from the receiving member.

FIG. 4 shows the helmet shell assembly 10 with the faceguard 14 with snap-in locations by the wearer's chin area (see the wing members 34 located behind the first and second chin projections 18, as well as the two receiving areas for the faceguard prong members 26 in the forehead/brow area on the front of the helmet shell 12.

Figure 6:
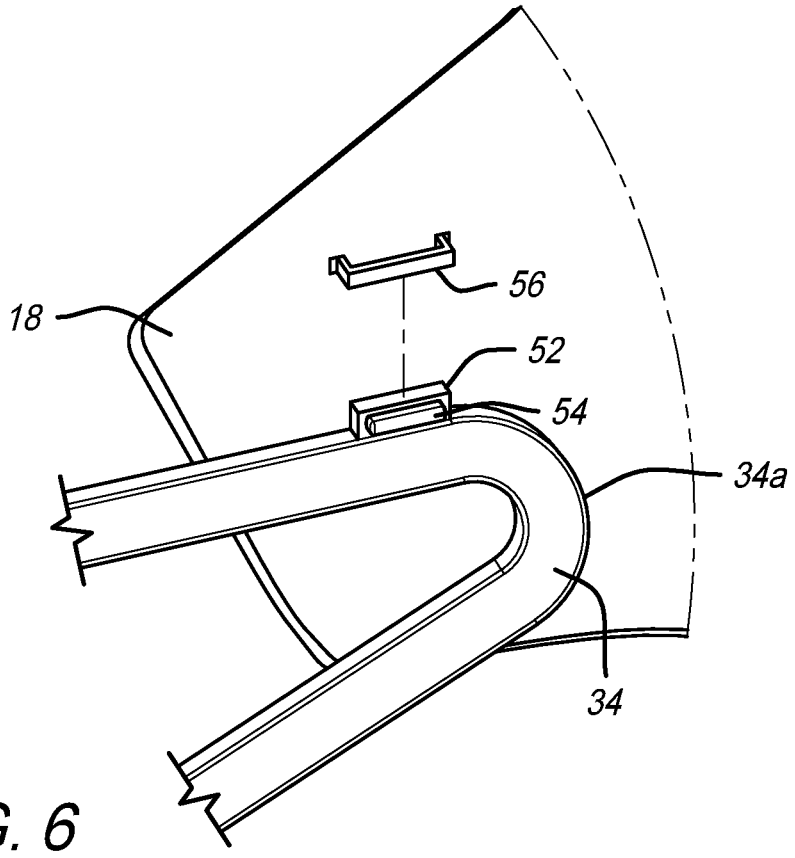
FIG. 6 is a cut away view of another faceguard attachment system in accordance with a preferred embodiment of the present invention.

In a preferred embodiment, the receiving members 36 include a top wall 44, a bottom wall 46 and a cover wall 48 that spans between the top and bottom walls. As shown in FIGS. 2 and 6, in a preferred embodiment, the bottom wall 46 has an inner surface 46*a* that when the wing member 34 is inserted into the receiving member 36 and the distal end 34*a* contacts the inner surface 46*a*, the distal end 34*a* follows a curved path as it goes through the receiving member 36. In a preferred embodiment, the curvature of inner surface 46*a* is approximately the same as the curvature of the prong member 26 (or the tunnel member interiors or the inner surface of the helmet shell). It will be appreciated that when the faceguard is attached or secured to the helmet shell or inner liner, the prong members are inserted into the tunnel members at approximately the same time or simultaneously with the wing members being inserted into the receiving members. Therefore, the entire faceguard will follow a curved path as it is moved from the loose position to the secured position. The combination of the wing members being secured in the receiving members and the associated components may be referred to herein as a lower faceguard securement system. Therefore, on a preferred embodiment, the helmet assembly includes upper and lower faceguard securement systems.

FIG. 6 shows an alternative embodiment of a lower faceguard securement system. In this embodiment, the wing members 34 include a tab 52 extending upwardly therefrom that includes a button 54 that is spring biased outwardly. A receiving bracket 56 is positioned on the inner surface of the chin projections 18. To connect or secure the wing member 34, the button 54 is pushed downwardly and the tab 52 is inserted into the receiving bracket 56. Button 54 works similarly to button 30.

Figure 7:
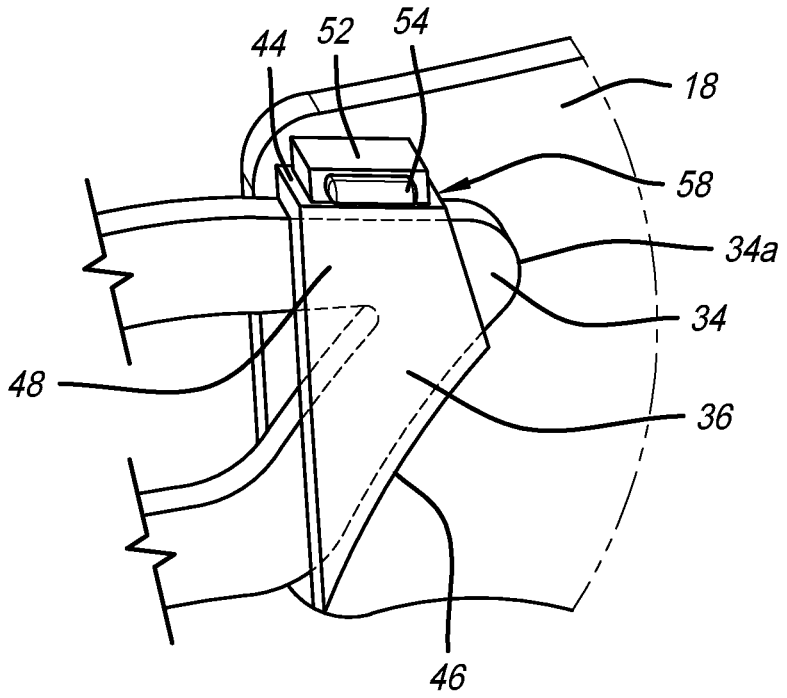
FIG. 7 is a cut away view of another faceguard attachment system in accordance with a preferred embodiment of the present invention.

FIG. 7 shows another alternative embodiment of a lower faceguard securement system that is essentially a combination of those shown in FIGS. 5 and 6. Instead of a receiving bracket, the receiving member 36 includes an opening 58 in the top wall 44 through which the tab 52 extends to secure the wing member 34 in place.

In a preferred embodiment, the helmet assembly 10 includes first and second noise attenuating ear port assemblies 60 that can include a number of different embodiments or features for noise attenuation, reduction or cancellation (referred to generally herein as noise attenuation) of the noise that comes through first and second ear ports 62.

Figure 8:
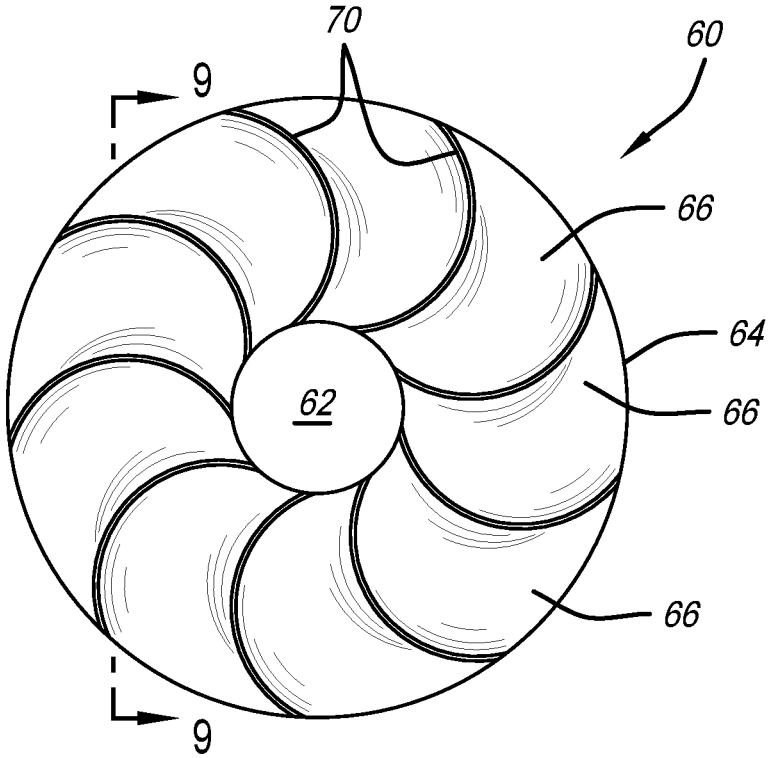
FIG. 8 is an elevational view of a noise attenuating ear port assembly that includes a plurality of spiral recesses defined in the outer surface of the helmet shell.
Figure 9:
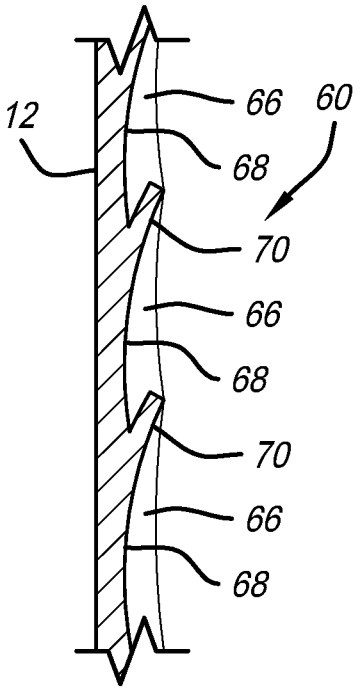
FIG. 9 is a cross-section taken along line 9-9 of FIG. 8.

As is best shown in FIGS. 8-9, in a preferred embodiment, the noise attenuating ear port assembly 60 includes a circular outer edge 64 and a plurality of spiral recesses 66 that are indented into and defined in the outer surface 12*b* of the helmet assembly. The spiral recesses 66 surround the ear port 62. The spiral recesses 66 include a bottom surface 68 that spirals inwardly from the circular outer edge 64 to the ear port 62. The spiral recesses 66 are separated by and at least partially defined by a plurality of walls 70. The spiral recesses and walls are formed or shaped similarly to the interior of a conch shell. The principals of noise attenuation of the spiral recesses is discussed above in the summary section. FIG. 9 shows a flat inside surface of the helmet shell. However, in another embodiment, the spiral recesses and the bottom surfaces thereof may extend or bulge into the helmet interior to provide more depth to the spiral recesses (more depth than the thickness of the remainder or majority of the helmet shell).

Figure 8A:
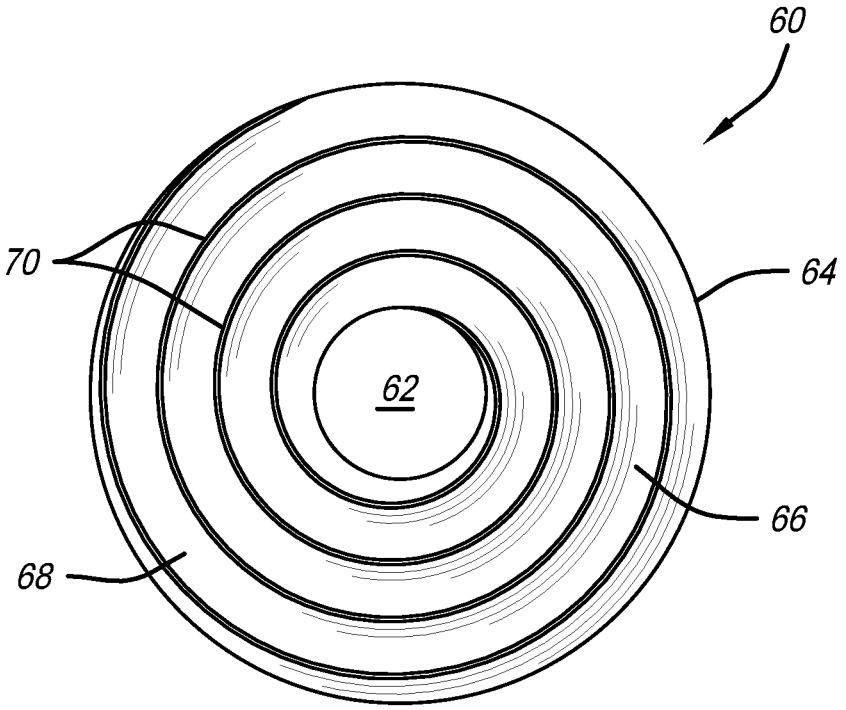
FIG. 8A is an elevational view of another embodiment of a noise attenuating ear port assembly that includes a plurality of spiral recesses defined in the outer surface of the helmet shell.

FIG. 8A shows another emodiment of the noise attenuating ear port assembly 60 similar to the one in FIG. 8, but including a single spiral recess 66 that spirals from the circular outer edge 64 and to the ear port 62. The sections of the spiral recess 66 are separated by and at least partially defined by a spiraling wall 70. The spiral recess and walls are formed or shaped similarly to the interior of a conch shell. The principals of noise attenuation of the spiral recesses is discussed above in the summary section. As shown, in the FIG. 8 embodiment, none of the separate spiral recesses 66 spiral a full 360°. However, in the FIG. 8A embodiment, the single spiral recess 66 includes individual spirals that spiral or surround the ear port and extend more than 360°. In another embodiment, the embodiments of FIGS. 8 and 8A can be combined such that a single spiral recess (that spirals more than 360°) includes a plurality of separate spiral recess sections (that extend between adjacent walls 70 of the single spiral recess) as the single spiral recess spirals from the circular outer edge 64 to the ear port 62. This combination can be seen in the cross-section of a conch shell. Instead of the circular ear port assembly shown in FIG. 8A, the spiral recess and/or ear port assembly can be shaped as the Fibonacci Sequence dictates, which may include a circular outer edge 64, but with an offset ear port or it may include a non-circular outer edge 64.

As shown in FIGS. 1 and 2, in another embodiment or in a combined with the spiral embodiment above, the noise attenuating ear assembly 60 includes an active noise cancellation assembly 72. Preferably, the active noise cancellation assembly 72 includes one or more speakers or transmitters 74 and one or more microphones or receivers 76 that are positioned in openings 78 that extend through the helmet shell 12. In another embodiment, the transmitters and receivers can be embedded in the helmet shell or positioned on the inner surface 12*a* of the helmet shell 12. In a preferred embodiment, the active noise cancellation assembly includes a controller 80 and a battery 82 and may also include a capacitor.

Figure 10:
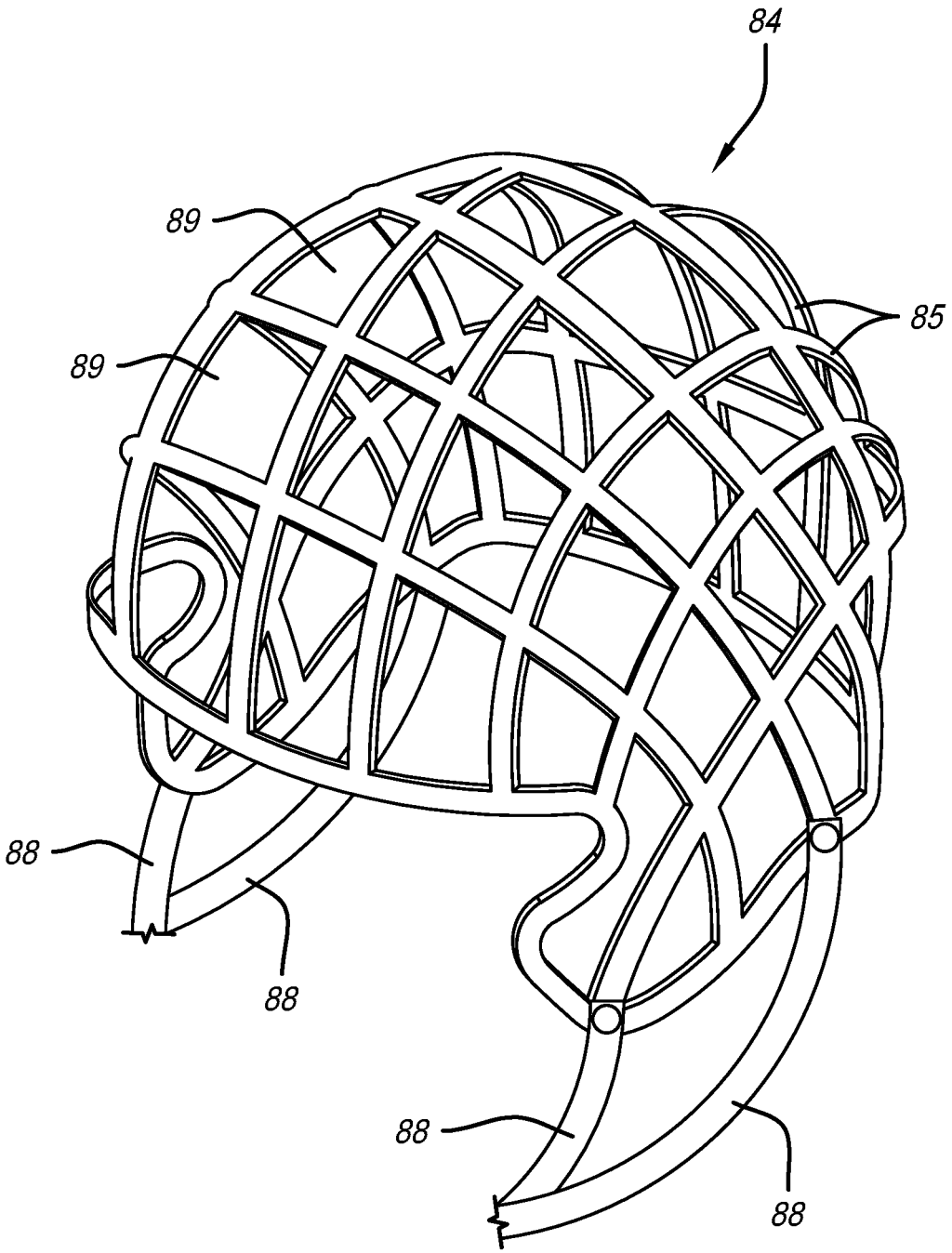
FIG. 10 is a perspective view of an inner liner that can be used with the helmet assembly of FIG. 1.

FIG. 10 shows an inner liner 84 that can be used in the magnetic helmet shell assembly disclosed in the '001 patent. The inner liner 84 comprises a plurality of band members 85 and has a rigid shape that mimics the interior of the helmet shell. As a result of the band members 85 and the openings 89 defined therebetween, the weight of the inner liner 84 is reduced compared to a solid inner liner. In use, magnets are secured to the outer surface of the inner liner. The magnets face or are opposed to magnets on the inner surface of the outer shell. Pads are secured to the inner surface of the inner liner 84 (similar to pads in prior art helmets).

Figure 11:
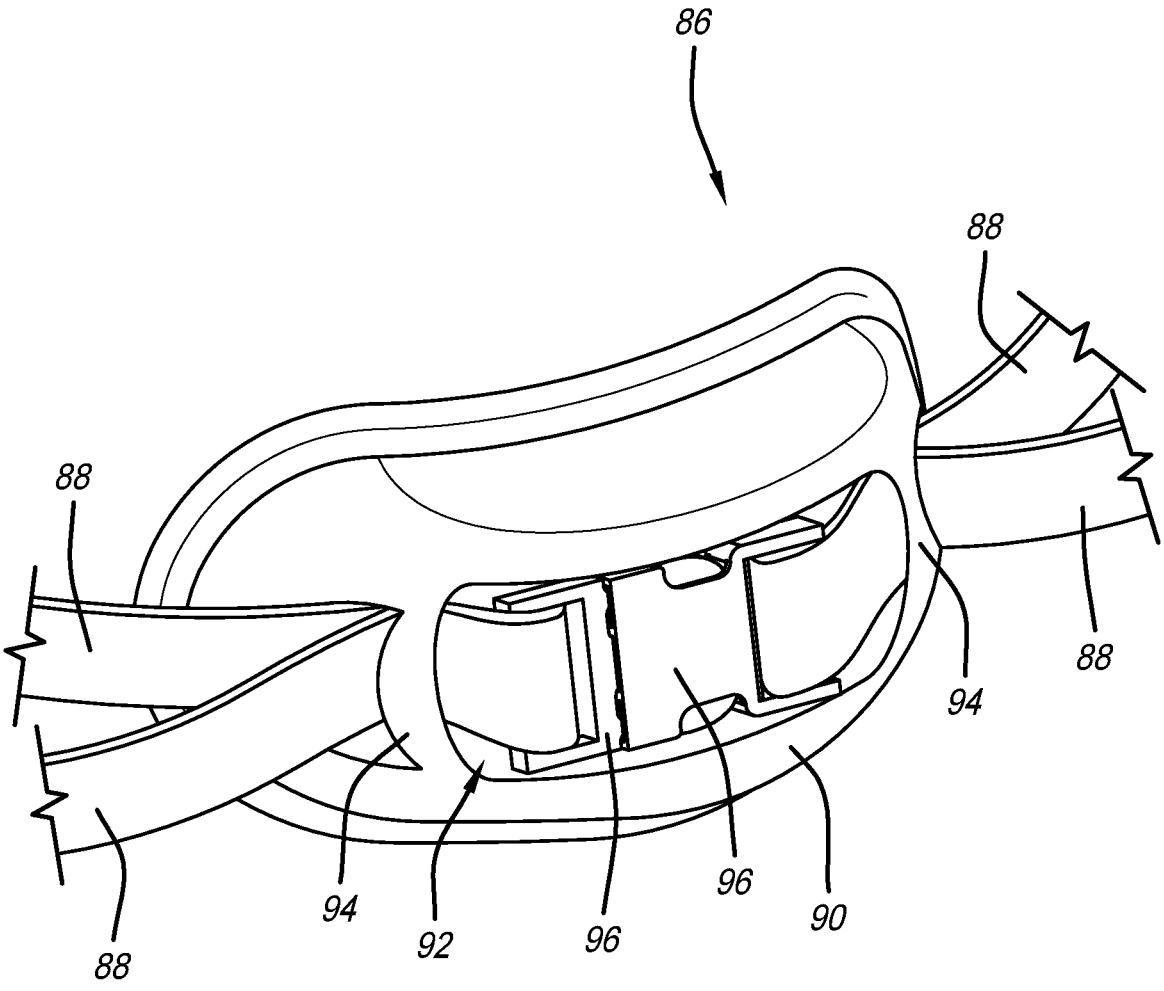
FIG. 11 is a perspective view of a chin strap that can be used with the helmet assembly of FIG. 1.

FIG. 11 shows a chin strap assembly 86 that can be connected to either the helmet shell 12 (in an embodiment without the inner liner) or the inner liner in an embodiment that includes opposing magnets. FIG. 10 shows the straps 88 extending from the inner liner 84. The straps are similarly connected to the helmet shell (on the inside or outside thereof) in an embodiment without the inner liner (or even on an embodiment with the inner liner, if desired). In a preferred embodiment, the straps 88 include elasticity or elastic sections therein that allows the straps to stretch when the helmet twists or moves.

As shown in FIG. 11, the chin strap assembly 86 includes a chin receiver member 90 that includes a trough 92 defined therein and first and second bridge members 94 that extend over the trough. The distal ends of the straps 88 each include a complementary latch member 96 for latching or connecting the ends of the two straps together. In a preferred embodiment, the trough 92 is deep enough so that the straps 88 and latch members 96 are seated within the trough 92 so that they are below the level of the outer surface of the chin receiver member 90. As a result, the straps 88 and latch members 96 do not "stick out" at all when properly seated. As shown in FIG. 11, the straps 88 extend under the bridge members 94.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art may recognize. Further, any specific numbers noted herein are only examples: alternative implementations may employ differing values, measurements or ranges.

The teachings of the disclosure provided herein can be applied to other systems, not necessarily the system described above. The elements and acts of the various embodiments described above can be combined to provide further embodiments. Any measurements described or used herein are merely exemplary and not a limitation on the present invention. Other measurements can be used. Further, any specific materials noted herein are only examples: alternative implementations may employ differing materials.

Any patents and/or patent applications and other references are articles noted above or herein, including any that may be listed in accompanying filing papers, charts or figures are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A helmet assembly comprising: a helmet shell that includes a face opening, first and second chin projections, an outer surface and an inner surface, wherein the face opening is at least partially defined by a horizontally extending forehead edge having a lower surface, wherein at least a tunnel member is disposed on the inner surface adjacent to and above the horizontally extending forehead edge, wherein a first receiving member is disposed on the inner surface on the first chin projection, and wherein a second receiving member is disposed on the inner surface on the second chin projection, and a faceguard that includes a lower section and an upper section, wherein the upper section includes a horizontally extending upper bar having an extension member extending upwardly therefrom, wherein the extension member has an inner surface that contacts the inner surface of the helmet shell, wherein the horizontally extending upper bar defines a first thickness and the extension member defines a second thickness, wherein the first thickness is greater than the second thickness, wherein the horizontally extending upper bar includes an upper surface, wherein a horizontally extending groove is partially defined by the inner surface of the extension member and the upper surface of the horizontally extending upper bar, wherein the lower surface of the horizontally extending forehead edge is received and in contact with the horizontally extending groove, wherein at least a first prong member extends upwardly from an upper surface of the extension member and above the horizontally extending forehead edge, wherein the first prong member is removably received in a secured position in the tunnel member, wherein the lower section includes a first wing member extending therefrom that is removably received in a secured position in the first receiving member and a second wing member extending therefrom that is removably received in a secured position in the second receiving member.

2. The helmet assembly of claim 1 wherein the first prong member is curved.

3. The helmet assembly of claim 2 wherein the first prong member includes a distal end, wherein when the first prong member is in the secured position, the distal end of the first prong member is located outside of the tunnel member.

4. The helmet assembly of claim 1 wherein the first wing member includes a proximal end and a distal end, wherein the proximal end is located between the lower section and the distal end, wherein when the first wing member is in the secured position, the distal end of the first prong member is located outside of the first receiving member, wherein the second wing member includes a proximal end and a distal end, wherein the proximal end is located between the lower section and the distal end, wherein when the second wing member is in the secured position, the distal end of a second prong member is located outside of the second receiving member.

5. The helmet assembly of claim 1 wherein the first receiving member and the first wing member include a first securement system that secures the first wing member in the secured position, and wherein the second receiving member and the second wing member include a second securement system that secures the second wing member in the secured position.

6. The helmet assembly of claim 5 wherein the first securement system includes a first latch member pivotably connected to the distal end of the first wing member, wherein the second securement system includes a second latch member pivotably connected to the distal end of the second wing member.

7. The helmet assembly of claim 1 further comprising an inner liner positioned inside the helmet shell, wherein the inner liner comprises a plurality of band members.

8. The helmet assembly of claim 1 further comprising a chin strap assembly that includes a chin receiver member and first and second straps, wherein the first and second straps each include a proximal end attached to the inner liner.

9. The helmet assembly of claim 8 wherein the chin receiving member includes a trough defined therein and first and second bridge members that span the trough, wherein the first strap extends under the first bridge member and into the trough, wherein the second strap extends under the second bridge member and into the trough, wherein the first and second straps include distal ends that include complementary latch members that are configured to latch to one another within the trough.

10. The helmet assembly of claim 9 wherein the trough is deep enough so that the straps and latch members are seated within the trough at a level below an outer surface of the chin receiver member.

11. The helmet assembly of claim 1 further comprising first and second noise attenuating ear port assemblies, wherein the first noise attenuating ear port assembly includes a first ear port defined through the helmet shell, wherein the second noise attenuating ear port assembly includes a second ear port defined through the helmet shell.

12. A helmet assembly comprising: a helmet shell that includes an inner surface, an outer surface, a face opening, first and second chin projections, and first and second noise attenuating ear port assemblies, wherein the first noise attenuating ear port assembly includes a first ear port defined through the helmet shell, wherein the second noise attenuating ear port assembly includes a second ear port defined through the helmet shell, wherein the face opening is at least partially defined by a horizontally extending forehead edge having a lower surface, wherein at least a tunnel member is disposed on the inner surface adjacent to and above the horizontally extending forehead edge, wherein a first receiving member is disposed on the inner surface on the first chin projection, and wherein a second receiving member is disposed on the inner surface on the second chin projection, and a faceguard that includes a lower section and an upper section, wherein the upper section includes a horizontally extending upper bar having an extension member extending upwardly therefrom, wherein the extension member has an inner surface that contacts the inner surface of the helmet shell, wherein the horizontally extending upper bar defines a first thickness and the extension member defines a second thickness, wherein the first thickness is greater than the second thickness, wherein the horizontally extending upper bar includes an upper surface, wherein a horizontally extending groove is partially defined by the inner surface of the extension member and the upper surface of the horizontally extending upper bar, wherein the lower surface of the horizontally extending forehead edge is received and in contact with the horizontally extending groove, wherein at least a prong member extends upwardly from an upper surface of the extension member and above the horizontally extending forehead edge, wherein the prong member is removably received in a secured position in the tunnel member, wherein the lower section includes a first wing member extending therefrom that is removably received in a secured position in the first receiving member and a second wing member extending therefrom that is removably received in a secured position in the second receiving member.

13. The helmet assembly of claim 12 wherein the first noise attenuating ear port assembly includes at least a first spiral recess defined in the outer surface of the helmet shell that at least partially surrounds the first ear port, wherein the second noise attenuating ear port assembly includes at least a second spiral recess defined in the outer surface of the helmet shell that at least partially surrounds the second ear port.

14. The helmet assembly of claim 13 wherein the first noise attenuating ear portion assembly includes a first circular outer edge, wherein the first spiral recess surrounds the first ear port and spirals inwardly from the first circular outer edge to the first ear port, wherein the second noise attenuating ear portion assembly includes a second circular outer edge, wherein the second spiral recess surrounds the second ear port and spirals inwardly from the second circular outer edge to the second ear port.

15. The helmet assembly of claim 12 wherein the first noise attenuating ear port assembly includes a plurality of first spiral recesses defined in the outer surface of the helmet shell, wherein the plurality of first spiral recesses surround the first ear port, wherein the second noise attenuating ear port assembly includes a plurality of second spiral recesses defined in the outer surface of the helmet shell, wherein the plurality of second spiral recesses surround the second ear port.

16. The helmet assembly of claim 15 wherein the first noise attenuating ear portion assembly includes a first circular outer edge, wherein the plurality of first spiral recesses each include a bottom surface that spirals inwardly from the first circular outer edge to the first ear port, wherein the second noise attenuating ear portion assembly includes a second circular outer edge, wherein the plurality of second spiral recesses each include a bottom surface that spirals inwardly from the second circular outer edge to the second ear port.

17. The helmet assembly of claim 15 wherein the plurality of first spiral recesses are separated by and at least partially defined by a plurality of walls, and wherein the plurality of second spiral recesses are separated by and at least partially defined by a plurality of walls.

18. The helmet assembly of claim 12 wherein the first noise attenuating ear port assembly includes a first active noise cancellation assembly, and the second noise attenuating ear port assembly includes a second active noise cancellation assembly.

19. The helmet assembly of claim 12 wherein the helmet assembly comprises a football helmet assembly.

* * * * *